US006328613B1

(12) United States Patent
Kashiyama

(10) Patent No.: US 6,328,613 B1
(45) **Date of Patent: *Dec. 11, 2001**

(54) TERMINAL DOUBLE LOCKING CONNECTOR

(75) Inventor: Motohisa Kashiyama, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/551,407

(22) Filed: Apr. 17, 2000

(30) Foreign Application Priority Data

Apr. 19, 1999 (JP) ..... 11-111042

(51) Int. Cl.[7] ..... H01R 13/436
(52) U.S. Cl. ..... 439/752
(58) Field of Search ..... 439/752, 595

(56) References Cited

U.S. PATENT DOCUMENTS

| | | | |
|---|---|---|---|
| 5,120,269 | 6/1992 | Endo et al. | 439/752 |
| 5,769,670 | 6/1998 | Abe | 439/752 |
| 6,183,313 * | 2/2001 | Kashiyama | 439/752 |

FOREIGN PATENT DOCUMENTS

| | | |
|---|---|---|
| 0 851 535 A2 | 1/1998 | (EP) . |
| 8-88042 | 4/1996 | (JP) . |
| 8-298152 | 11/1996 | (JP) . |

* cited by examiner

*Primary Examiner*—Gary F. Paumen
(74) *Attorney, Agent, or Firm*—Armstrong, Westerman, Hattori, McLeland & Naughton, LLP

(57) ABSTRACT

The connector includes a rear holder inserted into an opening 10 of a connector housing for locking terminals. The holder has a locking portion engaging with a rear end edge of the opening. The locking portion is formed with an inclined stopping surface. The stopping surface is facing in a disengaging direction of the holder and is capable of making a sliding contact with the rear end edge of the opening. The locking portion is a locking projection or may be an inclined stopping surface formed in a rear end portion of the holder. The holder has a base plate, a terminal locking projection, and a pair of side plates. The side plate is formed with a preliminary engagement portion associated with a preliminary locking portion of the connector housing. On final locking of the holder, the fore end face of the rear wall positioned behind the opening of the connector housing abuts against the rear end surface of the base plate of the holder.

4 Claims, 14 Drawing Sheets

TERMINAL DOUBLE LOCKING CONNECTOR

BACKGROUND OF THE INVENTION

1. Field of the Invention

The present invention relates to a terminal double locking connector having a rear holder for locking a terminal, in which the rear holder reliably engages with a housing of the connector.

2. Prior Art

FIGS. 18 and 19 show a known terminal double locking connector disclosed in Japanese Patent Application Laid-open No. H. 8-88042.

As illustrated in FIG. 18, a double locking connector 41 has a synthetic resin, male-type connector housing 42, a rear holder 44 joined to the connector housing 42 via a pair of hinges 43, and receptacle-type terminals 45 inserted into the connector housing 42.

The rear holder 44 has terminal locking projections 46 in a fore end portion thereof for locking the terminals 45. The rear holder 44 has a final locking projection 47 (FIG. 19) in a rear end thereof for the holder 44 to be locked in the connector housing 42. The preliminary lock projection will not be further discussed herein. In FIG. 19, the connector housing 42 is upside-down as compared with that of FIG. 18. As illustrated in FIG. 19, the connector housing 42 has an opening 48 faced perpendicular to the terminal insertion direction. In a rear end portion of the opening 48, there is provided an engagement groove 49 mating with the final locking projection 47.

In a lock released state of the rear holder 44 shown in FIG. 18, the terminal 45 is forwardly inserted into the connector housing 42. The terminal 45 is preliminarily locked by a resilient lock lance 50 (FIG. 19) of the connector housing 42. Next, inserting the rear holder 44 diagonally forward into the connector housing 42 causes the terminal locking projection 46 to further lock the terminal 45 as illustrated in FIG. 19. On releasing of the terminal 45 for maintenance, the rear holder 44 is forcedly unlocked by using a bar tool (not shown) or the like so that the final locking projection 47 disengages from the groove 49 to release the rear holder 44.

In FIG. 19, denoted 51 is a female-type connector housing, 52 an opposing pin terminal, 54 a lock arm, 55 a lock projection of the lock arm 54, and 56 an engagement portion associated with the lock projection 55. The rear holder 44 is positioned as opposed to the lock arm 54.

However, the known double locking connector has the disadvantage that a repetition of engagement and disengagement of the rear holder 44 causes a wear or a permanent deformation (sagging) of the final locking projection 47, resulted in a reduced engagement force to bring about an unintentional release of the rear holder 44. In addition, a larger clearance between the rear holder 44 and the connector housing 42 tends to disengage the final locking projection 47 from the engagement groove 49, causing disadvantageously an unintentional release of the rear holder 44. Particularly, a larger drawing-out force exerted on an electric cable 53 tends to cause a lock release of the rear holder 44, which reduces the locking force of the terminal 45, resulting in an undesirable disengagement of the terminal 45 from the connector housing 42.

Meanwhile, FIGS. 20 and 21 show a known double locking connector disclosed in Japanese Patent Application Laid-open No. H. 8-298152.

As illustrated in FIG. 20, the double locking connector 100 consists of a male-type connector housing 103 formed with two-layered upper and lower terminal accommodating chambers 101, 102, a pair of rear holders (retainers) 107, 108 each inserted diagonally forward into one of upper and lower openings 104, 105 formed in a rear part of the connector housing 103, and receptacle-type terminals (not shown) received in the terminal accommodating chambers 101, 102. The pair of rear holders 107, 108 each have a shape different from each other.

The connector housing 103 has an upper wall formed with a resilient lock arm 109 for locking an opposing male-type connector (not shown). The lock arm 109 has a lock projection 110 in the middle thereof and has a push projection 111 at a rear end side thereof. The lock projection 110 engages with, for example, an opening formed in a hood wall of an opposing male-type connector housing (not shown). The upper rear holder 107 is inserted into the connector housing 103 with the holder crossing over the lock arm 109, and a narrow middle portion 112 of the rear holder 107 is positioned between the lock projection 110 and the push projection 111.

The upper opening 104 communicates with the terminal accommodating chambers 101 by way of entrance holes 113. In a rear end side of the opening 104, there is provided a guide inclined surface 114 for the rear holder 107. In each side portion of the opening 104 of the connector housing 103, there are provided a preliminary lock projection 115, a guide projection 116, and a final locking projection 117, which are associated with one of the rear holders 107, 108.

Each rear holder 107 or 108 has a base plate 118 or 119 and terminal locking projections 120 or 121. Each rear holder 107 or 108 has side walls 122, 123, and each side wall 122 or 123 has an engagement recess 124 receiving one of the projections 115 to 117 formed on the side portions of the connector housing 103. The upper rear holder 107 has a raised middle portion which is reduced in width. Meanwhile, the lower rear holder 108 transversely extends straight with a uniform width.

Inserting diagonally forward each rear holder 107 or 108 into the opening 104 or 105 of the connector housing 103 allows a preliminary lock of the rear holders 107, 108, as illustrated in FIG. 21. In this preliminary lock state, for example, there may be a clearance L2 between the side wall 122 of the rear holder 107 and a fore end of the opening 104 of the connector housing 103, and there may be also another clearance L3 between the middle portion 112 of the rear holder 107 and the lock projection 110. In the preliminary lock state, the connector housing 103 of the rear holder 107 receives the terminals (not shown) inserted therein.

A further advancement of the rear holder 107 abuts a fore end of the rear holder 107 against a fore edge of the opening 104, and the side final locking projections 117 finally lock the rear holder 107. Between the lock projection 110 and the middle portion 112 of the rear holder 107, there is a small clearance of L3–L2.

However, the known double locking connector 100 has the disadvantage that the rear holder 107 tends to be unintentionally drawn out diagonally upward along an inclined surface 114 (FIG. 20) of the connector housing 103. This unintentional drawn-out of the finally locked rear holder 107 occurs when an electric cable (not shown) connected to a terminal is forcibly pulled or when a terminal is forcibly pushed rearward on mating with an opposing connector. Particularly, since the connector housing 103 has the final locking projection 117 provided in each side thereof for engaging with the engagement portion 124 of the rear holder 107, the rear holder 107 tends to deflect at its middle part 112 by a forcible pulling force exerted on the electric cable with the terminal. This may cause a disengagement of the rear holder 107 against the lock force of the final locking projections 117. Furthermore, between the lock projection 110 and the middle part 112 of the rear holder 107, there is a small clearance of L3–L2 on a finally locked state of the rear holder 107. Thus, as illustrated in FIG. 22, the width L5 of an engagement portion 126 of an opposing male-type connector housing 125 must be smaller so as to be received within the distance L4 between the lock projection 110 and the push projection 111 of the lock arm 109. This causes a reduced rigidity of the engagement portion 126, resulted in an undesired unlock of the lock arm 109.

SUMMARY OF THE INVENTION

In view of the disadvantages of the known connectors, an object of the invention is to provide a double locking connector (or a locking structure of a rear holder) having a rear holder which is not unintentionally released from the connector housing when a terminal accommodating in the connector housing receives a force caused by pulling an electric cable connected to the terminal. Particularly, no unintentional release of the rear holder occurs even where there is a comparatively large clearance between the rear holder and the connector housing in a engaged state thereof. Furthermore, the rear holder has a locking force not reduced by a repetition of disengagement of the rear holder from the connector housing.

For achieving the object, a terminal double locking connector according to a first aspect of the present invention includes:

a connector housing, a terminal inserted into the connector housing, and a rear holder for locking the terminal, which is inserted into an opening of the connector housing in a direction intersecting with the terminal insertion direction, the rear holder having a locking portion engaging with a rear end edge of the opening. The locking portion has an inclined stopping surface facing in a disengaging direction of the rear holder, and the inclined stopping face can slide along the rear end edge of the opening of the connector housing during the insertion of the rear holder.

The locking portion of the rear holder may be a locking projection. The rear end of the rear holder may have the inclined stopping face to compose the locking portion.

A terminal double locking connector according to a second aspect of the present invention includes a connector housing, a terminal inserted into the connector housing, and a rear holder for locking the terminal, which is inserted into an opening of the connector housing in a direction intersecting with the terminal insertion direction, the rear holder having a locking portion engaging with a rear end edge of the opening. The rear holder has a base plate, a terminal locking projection formed on the base plate, and a pair of side plates extending from the base plate, each of the side plates having a preliminary engagement portion associated with a preliminary lock portion formed on the connector housing, and the base plate of the rear holder has a rear end surface abutting against a fore face of a rear wall of the connector housing on final locking of the rear holder, the rear wall being positioned at the back of the opening.

Next, operation of the above-mentioned configurations of the double locking connectors will be discussed.

In the configurations described in the first aspect of the invention, the connector housing receives the terminal, and the rear holder is inserted into the opening. The rear holder prevents the terminal from being pulled out rearward. When there is a comparatively large clearance between the rear holder and the connector housing so that the rear holder floats in its disengaging direction, the inclined stopping face of the locking portion abuts against the rear end edge of the opening of the connector housing. That is, when the terminal accommodating in the connector housing receives a force caused by pulling an electric cable connected to the terminal so that the rear holder receives the disengaging force, the inclined stopping face slidingly abuts against the rear end edge of the opening of the connector housing. Thereby, the rear holder receives a reaction force in its engaging direction, preventing the rear holder from being released from its final lock state.

In the configuration described in the second aspect of the invention, the rear holder is preliminarily locked by each side plate. Then, pushing the rear holder into the opening of the connector housing causes the rear end surface of the base plate of the rear holder to abut against the fore end face of the rear wall of the connector housing, thereby finally locking the rear holder to the connector housing. Thus, the rear holder does not deflect in the middle thereof to achieve a reliable final lock unlike the known connectors in which only the side plates serve for its final locking.

Next, advantageous effects of the invention will be discussed. As described above, in the first aspect of the invention, when a terminal drawing-out force caused by pulling the electric cable, the inclined stopping surface of the rear holder slidingly abuts against the rear end edge of the opening to return the rear holder in its engaging direction within the connector housing. This prevents the unintentional releasing of the rear holder, allowing a reliable locking of the terminals. This advantageous effect is also provided when there is a clearance between the rear holder and the connector housing which causes the rear holder to be floated in its disengaging direction.

Furthermore, on intentional disengaging of the rear holder, the inclined stopping surface of the locking portion slides smoothly the rear end edge of the opening. Thus, a repetition of engagement and disengagement of the rear holder causes neither wear nor deformation of the locking portion, preventing the decrease in locking force of the rear holder to keep a reliable locking force for the terminals.

Particularly, the locking projection might have an adequate flexibility (resiliency) to prevent furthermore the wear and deformation of the rear holder on its engagement and disengagement. The locking portion might have a sufficient rigidity, causing no deformation of the locking portion even on a repetition of engagement and disengagement of the rear holder.

In the invention described in the second aspect of the invention, when a terminal drawing-out force is caused by pulling the electric cable, the rear end surface of the base plate of the rear holder abuts against the fore end face of the rear side wall of the connector housing. This provides a sufficient engagement force, preventing the rear holder from deflecting in an arcuate shape unlike the known connector of which the rear holder deflects between both the side plates (final locking portions). Thus, the rear holder of the present invention is reliably kept in its final lock state, resulted in an increased sufficient locking force for the accommodated terminals.

DETAILED DESCRIPTION OF THE PREFERRED EMBODIMENT

Referring to the accompanied drawings, embodiments of the present invention will be discussed in detail hereinafter.

FIGS. 1 to 11 show a terminal double locking connector 1 according to a first embodiment of the present invention. The double locking connector 1 is an improvement of one that the applicant of the present invention has proposed in Japanese Patent Application No. H. 10-22293. The improvement is related to a locking structure of a rear holder (terminal double locking member) of the double locking connector.

Figure 1:
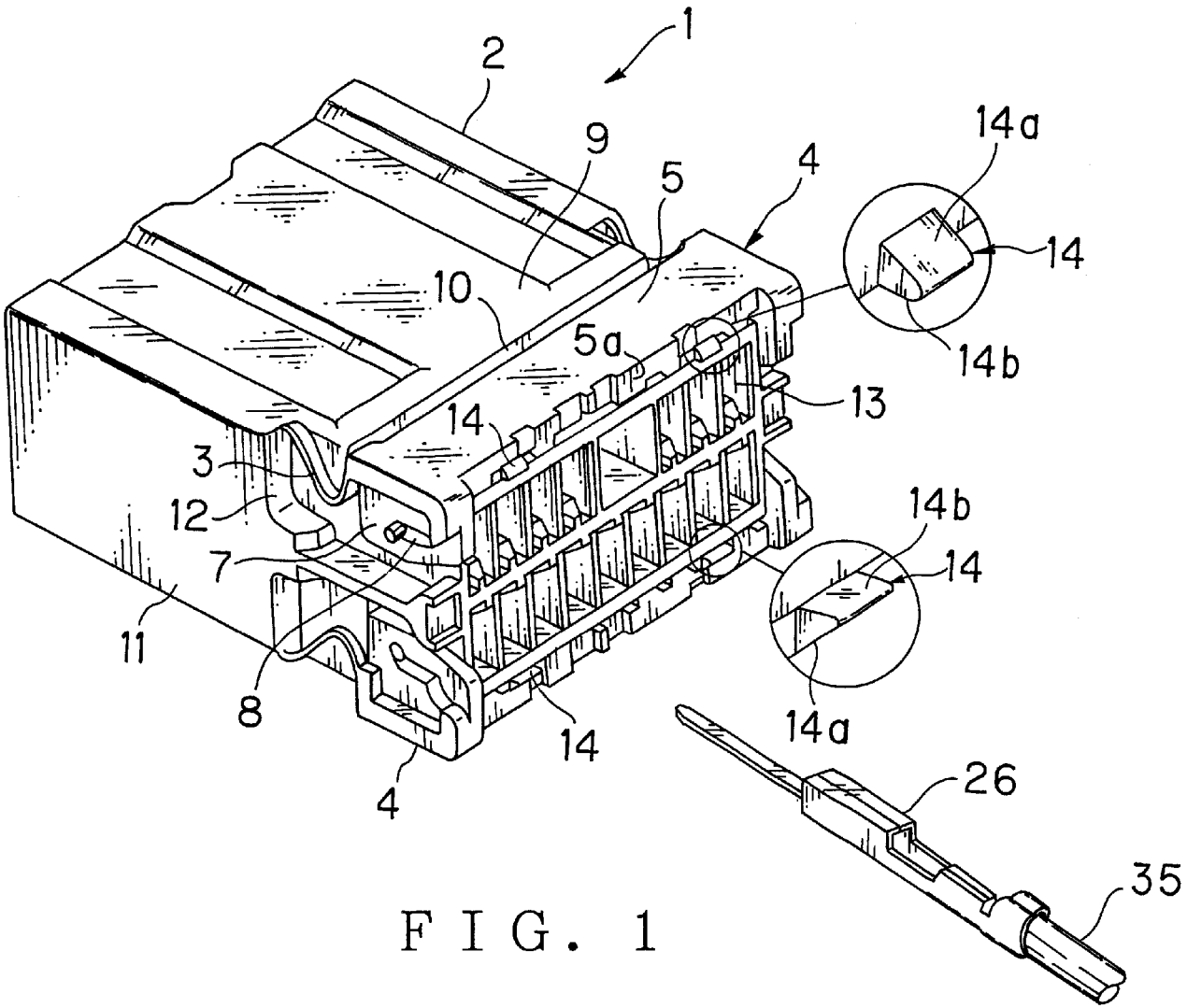
FIG. 1 is an exploded perspective view showing a first e embodiment of a terminal double locking connector according to the present invention, and encircled is an enlarged view of a final locking projection of the connector.

As illustrated in FIG. 1, the double locking connector 1 has a synthetic resin, female-type connector housing 2, two synthetic resin rear holders 4 coupled to the connector housing 2 via thin resilient hinges 3, and a plurality of pin-type terminals 26 inserted into a plurality of terminal accommodating chambers 13 of the connector housing 2. Each rear holder 4 has a rear end formed with a pair of left and right final locking projections (locking portions) 14. Each final locking projection 14 has an inclined stopping surface 14*a* abutting against the connector housing 2.

The rear holder 4 has a base plate 5, a plurality of terminal locking projections 6 (FIG. 3) extending from a fore end of the base plate 5, and a side plate 7 vertically formed at each side end of the base plate 5. The side plate 7 is formed with a generally S-shaped guide opening 8.

The pair of rear holders 4 each are inserted into one of upper and lower spaces each formed in a rear part of the connector housing 2. The connector housing 2 has upper and lower walls 9 each formed with an opening 10 for receiving one of the rear holders 4.

The connector housing 2 also has each side wall 11 formed with a receiving space 12 for receiving a side plate 7 of the rear holder 4. The side plate 7 has a thin thickness to be flexible in its thickness direction. Each side plate 7 is positioned outside the opening 10. The hinge 3 is extending from the upper or lower wall 9 of the connector housing 2 into a fore part of the receiving space 12 and can be curved in the receiving space 12. The other end of the hinge 3 is joined to a fore, side end of the rear holder 4.

The rear holder 4 has the plurality of terminal locking projections 6 (FIG. 3) to define a comb-like shape, each of which corresponds to one of the accommodating chambers 13 of the connector housing 2. The base plate 5 has a rear end 5*a* formed with two locking projections 14 each of which engages with a rear end edge 10*a* (FIG. 4) of the opening 10. The final locking projection 14 is triangular in longitudinal section. The final locking projection 14 protrudes backward from the rear end face 5*a* of the base plate 5 in an opposite side of the terminal locking projections 6. The final locking projection 14 is positioned adjacent to an inner side surface 5*b* (FIG. 4) of the base plate 5.

Figure 2:
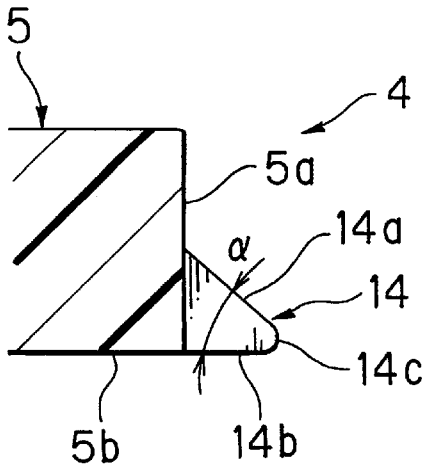
FIG. 2 is a longitudinal sectional view showing of a final locking projection of a rear holder of FIG. 1.

That is, the final locking projection 14 has a horizontal face 14*b* which aligns with the inner side surface 5*b* (FIG. 2) of the base plate 5. The final locking projection 14 has an inclined stopping surface 14*a* facing to the disengaging direction of the rear holder 4 outside the base plate 5. The inclined stopping surface 14*a* engages with the rear edge 10*a* (FIG. 4) of the opening 10 of the connector housing 2. As illustrated in FIG. 2, the inclined stopping surface 14*a* is adjacent to the rear end face 5*a* of the base plate 5. An outward end 14*c* of the final locking projection 14 is formed in a round shape. Preferably, the stopping surface 14*a* has an incline angle $\alpha$ of about 30° to 45°.

The stopping surface 14*a*, as is further discussed later, provides a sliding surface for the rear end edge 10*a* (FIG. 4) of the opening 10 of the connector housing 2. A further larger incline angle $\alpha$ of the stopping surface 14*a* is disadvantageous in slidableness and reduces the final lock force thereof. The pair of left and right final locking projections 14 shown in FIG. 1 cause the transversely elongated rear holder 4 to reliably engage with the connector housing 2. Furthermore, the vertical rear end face 5*a* of the base plate 5 abuts against a fore end face 29*a* of a rear wall 29 (FIG. 4) of the connector housing 2, which increases the final lock force of the terminals. In FIG. 1, there is illustrated the rear holder 4 which is in the preliminary lock state.

Figure 3:
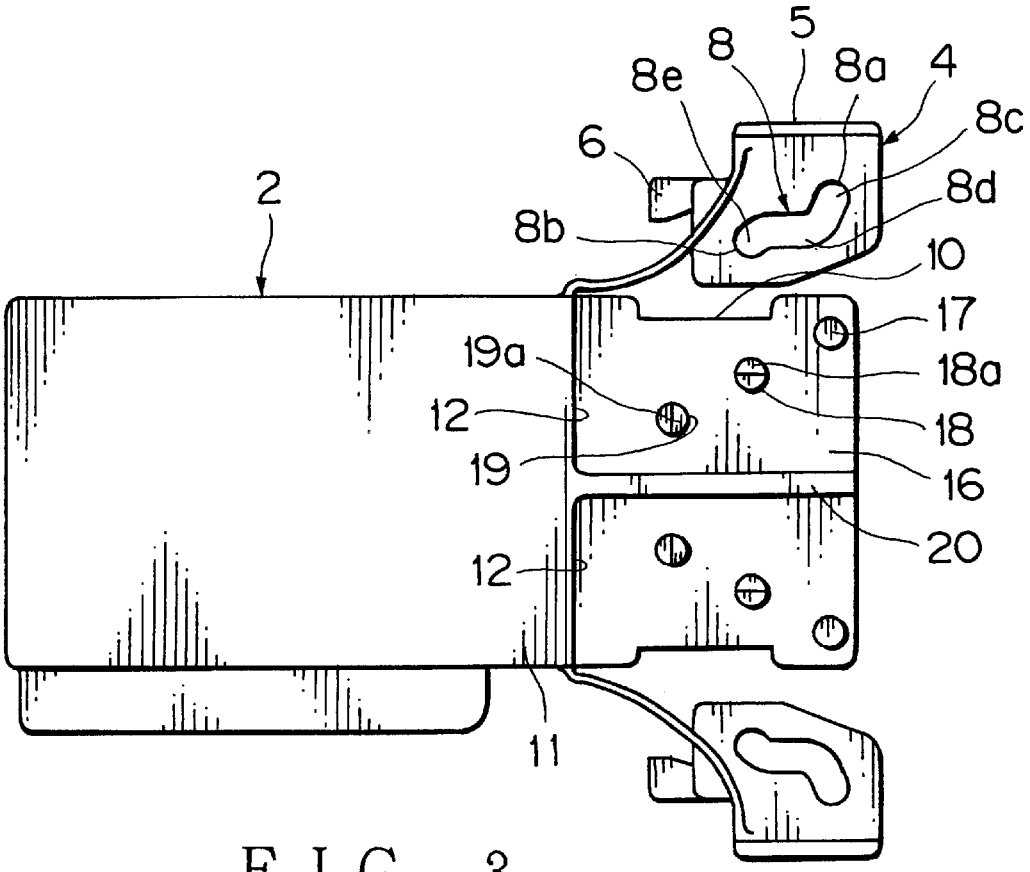
FIG. 3 is a side view showing a state in which the connector housing is disengaged from the rear holder.

In FIG. 3, there is illustrated the rear holder 4 which is in the fully disengaged state thereof. In a side wall 16 for the receiving space 12 of the connector housing 2, there are sequentially disposed a preliminary lock projection (preliminary lock portion) 17, a guide projection 18 for the rear holder 4, and a final lock assisting projection (second guide projection) 19. These projections 17 to 19 is disposed on a phantom inclined line leading to the center of the connector housing 2.

The preliminary lock projection 17 and the final lock assisting projection 19 has a height smaller than the guide opening 8. Meanwhile, the intermediate guide projection 18 is a circular column having a height approximately twice larger than the projections 17, 19 and almost the same as the depth of the guide opening 8. The guide projection 18 and the final lock assisting projection 19 each has a head formed with a tapered surface 18*a* or 19*a*.

As illustrated in FIG. 3, Each distance between any two of the projections 17 to 19 is predetermined to conform to the length of the guide opening 8. Thereby, adjacent two (17 and 18, or 18 and 19) of the three projections 17 to 19 may engage with a fore end portion 8*b* or a rear end portion 8*a* of the guide opening 8 of the rear holder 4.

The guide opening 8 extends from its rear end portion 8*a* near the base plate 5 and leads to an elongated horizontal straight groove 8*d* by way of a steeply inclined groove (preliminary engagement portion) 8*c*. Then, the guide opening 8 leads to a comparatively gentle sloped groove 8*e* in the fore side of the straight groove 8*d* and reaches the fore end portion 8*b*. In FIG. 3, denoted 6 is the terminal locking projection, and 20 a partition separating the upper and lower receiving spaces 12.

Figure 4:
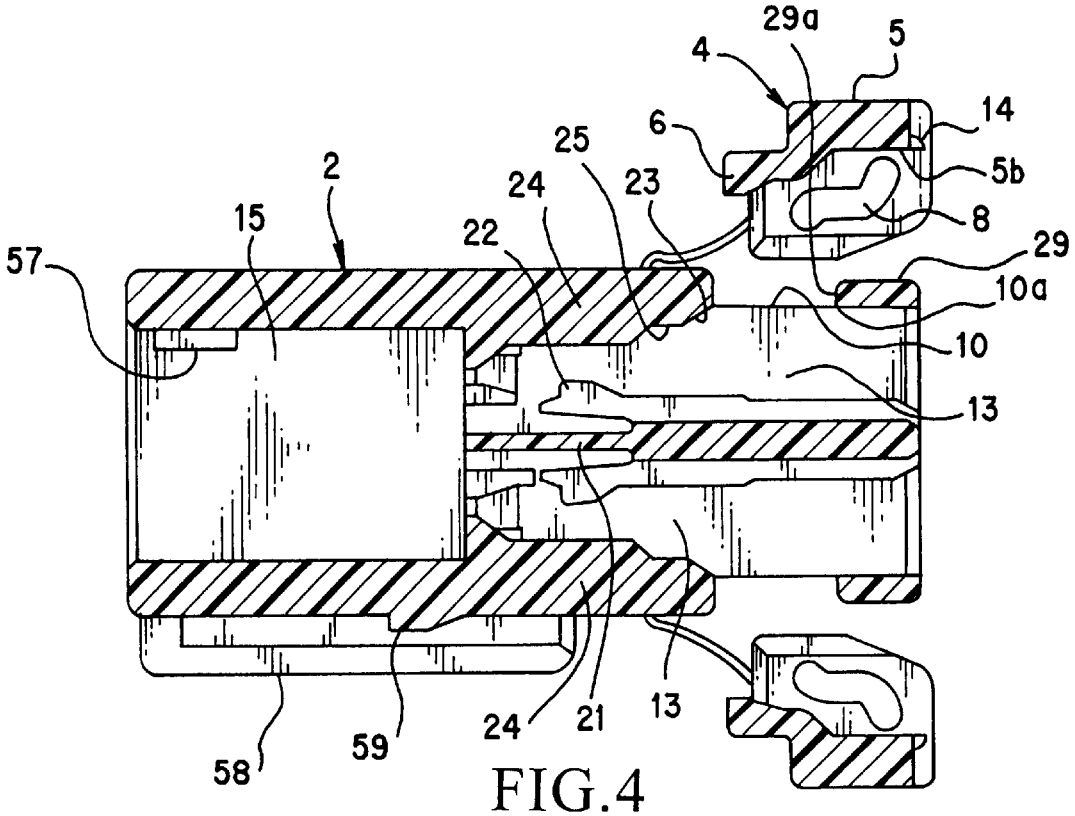
FIG. 4 is a longitudinal sectional view showing a state in which the connector housing is disengaged from the rear holder.

FIG. 4 shows a longitudinal sectional view of the connector housing 2 and the rear holder 4. The connector housing 2 has a wall 21 for isolating the symmetrical upper and lower terminal accommodating chambers 13. The wall 21 has a plurality of resilient lock lances 22. The terminal accommodating chambers 13 lead to a forward connector engagement space 15. The opening 10 for inserting the rear holder is opened to the terminal accommodating chamber 13, so that each terminal locking projection 6 of the rear holder 4 may enter one of the terminal accommodating chambers 13. The terminal locking projection 6 is positioned inside the base plate 5 to define a step.

At a fore end of the opening 10, there is provided a tapered guide surface 23 for the terminal locking projections 6. Ahead of the tapered guide surface 23, there is provided an entrance face 25 formed in an inner wall 24 of the connector housing 2 for guiding the terminal locking projections 6. The entrance face 25 leads to the terminal accommodating chambers 13.

In FIG. 4, denoted 57 is an engagement portion for a lock arm of an opposing male-type connector (not shown), 58 a sliding engagement portion for securing the female-type connector housing 2, and 59 a locking projection for locking the connector housing 2. The female-type connector housing 2 has no lock arm for engagement with the male connector, which is advantageous to keep a space enough for adequately receiving the rear holder 4.

Figure 5:
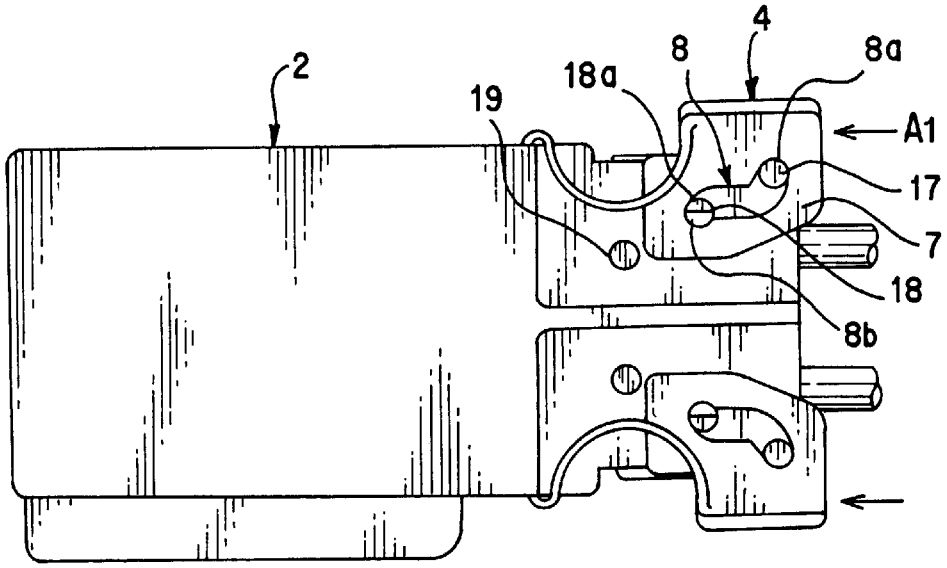
FIG. 5 is a side view showing a preliminary lock state in which the connector housing has received the rear holder.
Figure 6:
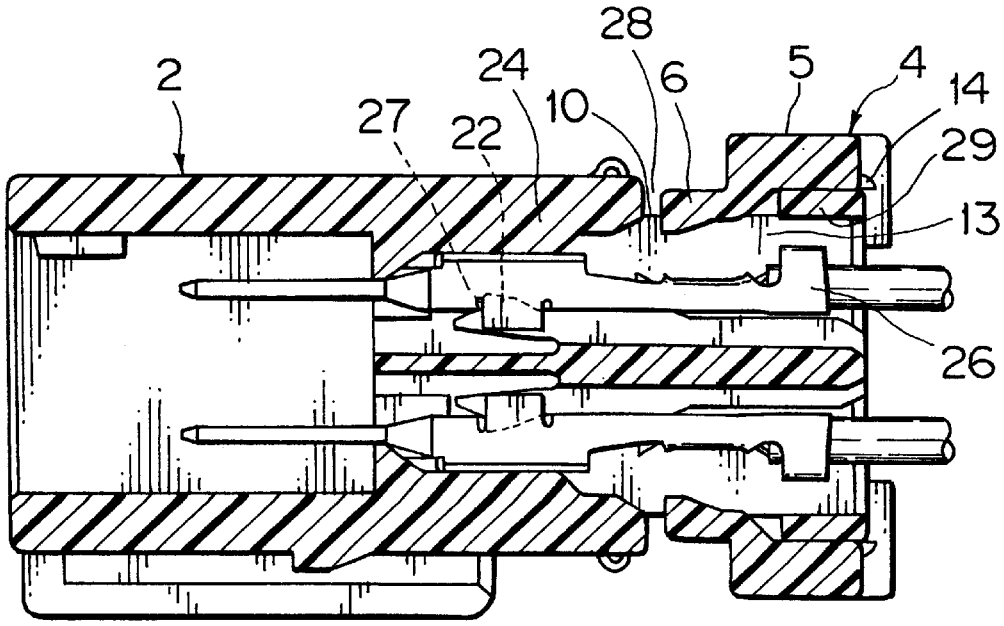
FIG. 6 is a longitudinal sectional view showing a state in which terminals have been inserted in the connector housing with the rear holder being preliminary locked.

FIGS. 5 and 6 show a preliminary lock state of the connector housing 2 and a rear holder 4. As illustrated in FIG. 5, the rear end portion of the guide opening 8 abuts against the preliminary lock projection 17, and the fore end portion 8*b* of the guide opening 8 abuts against the guide the projection 18. Near and forward a fore end of the side plate 7 of the rear holder 4, there is positioned the final lock assisting projection 19.

On engagement of each projection 17, 18 with the guide opening 8, the side plate 7 deflects outward along the tapered guide surface 18*a* of the guide the projection 18, so that each projection 17 or 18 may smoothly engage with the guide opening 8. The preliminary lock projection 17 having a shorter height than the guide projection 18 allows its smooth engagement with the guide opening 8 even without a tapered guide surface of the preliminary lock projection 17.

As illustrated in FIG. 6, in the preliminary lock state of the rear holder 4, the terminals are inserted forward into the terminal accommodating chambers. An engagement opening or an engagement cu-out shoulder 27 of the terminal 26 engages with a projection of the lock lance 22. The terminal locking projection 6 of the rear holder 4 is still within the opening 10. Between the foremost end of the terminal locking projection 6 and the fore end of the opening 10, there is a clearance 28. The base plate 5 of the rear holder 4 is contacting a comparatively thin wall 29 positioned in the rear of the opening 10. The rear wall 29 is a part of the inner wall 24, and a fore end face of the rear wall 29 defines a rear end face of the opening 10.

In the preliminary lock state of the rear holder 4 shown in FIG. 5, pushing forward the rear end of the base plate 5 in an arrow head A1 direction provides a pivoting force for the rear holder 4 around the projections 17, 18, particularly around the projection 18.

Figure 7:
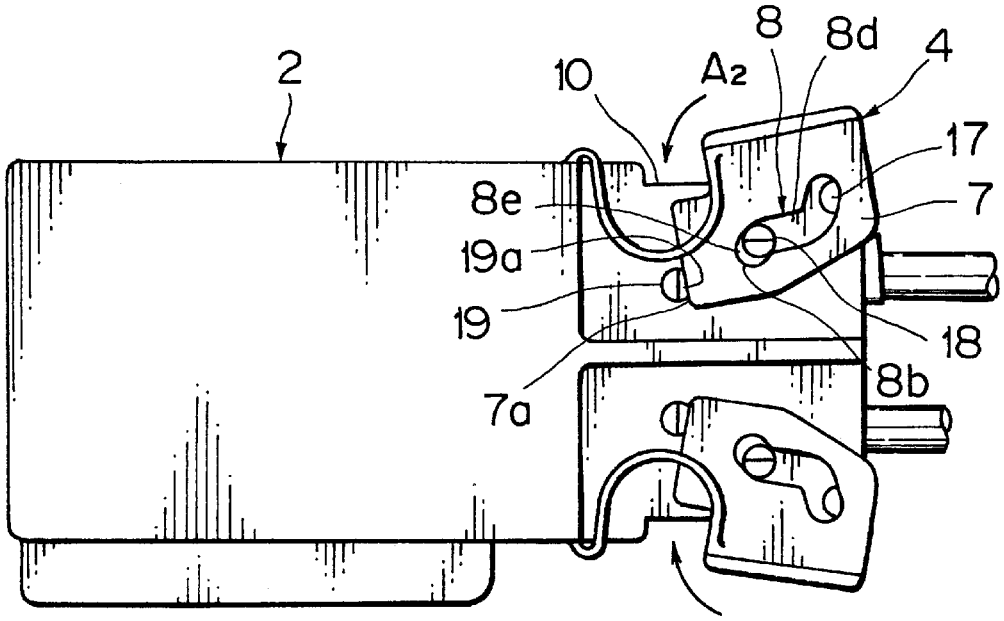
FIG. 7 is a side view a state in which the rear holder is inserted into the connector housing.
Figure 8:
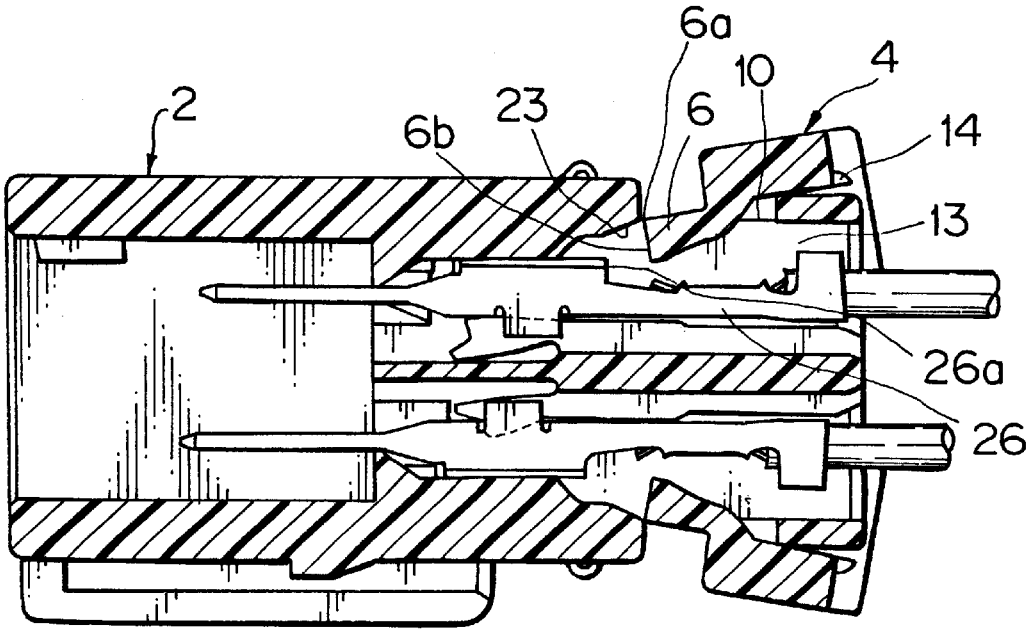
FIG. 8 is a longitudinal sectional view showing a state in which the rear holder is inserted into the connector housing.

Thus, as illustrated in FIGS. 7 and 8, the head of the rear holder 4 moves inside in an arrow head A2 direction to pivot itself together with advance of the rear holder 4 in the opening 10 of the connector housing. In FIG. 7, the preliminary lock projection 17 is disengaging from the guide opening 8 (at the same time, the side plate 7 is deflecting outward). Meanwhile, the guide the projection 18 is leaving from the short inclined groove 8*e* (and from the fore end portion 8*b*) of the guide opening 8 to enter into the straight groove 8*d*. Furthermore, a fore end portion 7*a* of the side plate 7 of the rear holder 4 is contacting the final lock assisting projection 19, which enhances the pivoting movement of the rear holder 4 around the final lock assisting projection 19.

As illustrated in FIG. 8, the terminal locking projection 6 of the rear holder 4 moves forward from the opening 10 of the connector housing 2 into the terminal accommodating chamber 13 with its pivoting movement. Then, an outer, fore end shoulder 6*a* of the terminal locking projection 6 contacts an end of the tapered guide surface 23 positioned at the front of the opening 10.

With the pushing operation of the rear holder 4, as shown in FIG. 7, the straight groove 8*d* of the guide opening 8 moves slidingly diagonally along the guide the projection 18. At the same time, as shown in FIG. 8, the fore end shoulder 6*a* of the terminal locking projection 6 moves slidingly diagonally along the tapered guide surface 23. Thereby, a locking portion 6*b* which is an inner, fore end part of the terminal locking projection 6 moves diagonally toward the shoulder 26*a* of the terminal 26.

Figure 9:
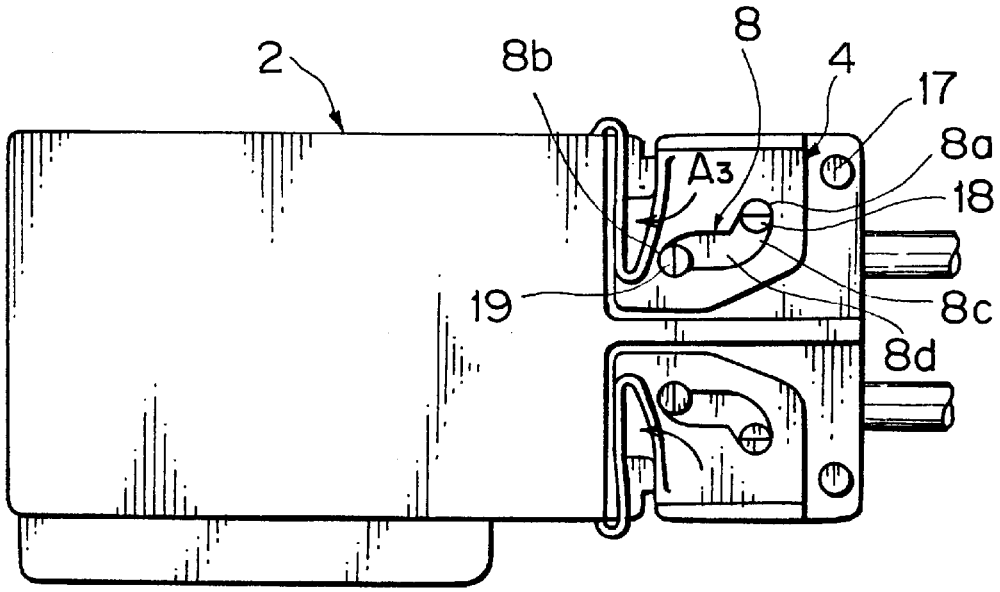
FIG. 9 is a side view showing a state in which the rear holder is finally locked in the connector housing.

In FIG. 7, the tapered guide surface 19*a* of the final lock assisting projection 19 forcedly moves under an inside surface of the side plate 7 of the rear holder 4, which deflects the side plate 7. Thereby, as illustrated in FIG. 9, the final lock assisting projection 19 enters the opening 8. With the pushing operation of the rear holder 4, as illustrated in FIG. 9, the guide projection 18 enters into the elongated inclined groove 8*c* of the guide opening 8 by way of the straight groove 8*d*. Thereby, the rear holder 4 fully engages with the opening 10 with pivoting in an arrow head A3 direction, which is opposite in direction of the arrow head A2 shown in FIG. 7, toward the terminal insertion direction.

Figure 10:
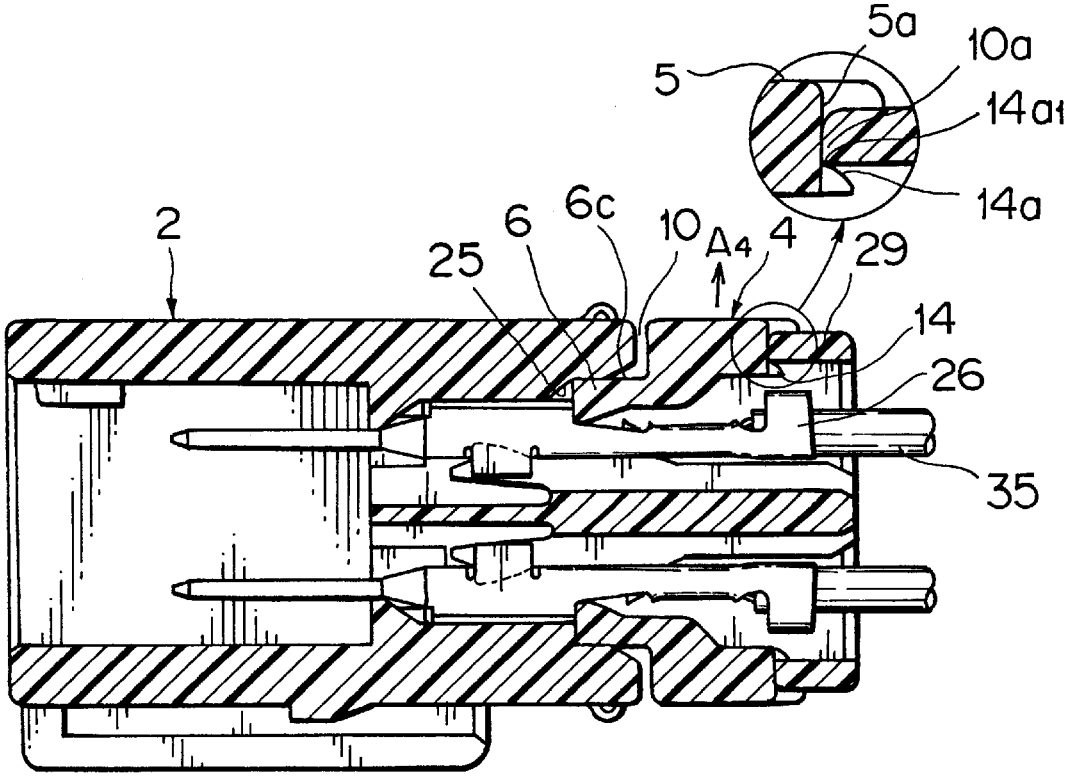
FIG. 10 is a longitudinal sectional view showing a state in which the rear holder is finally locked in the connector housing.

FIGS. 9 and 10 show a final lock state of the rear holder 4. As shown in FIG. 9, the final lock assisting the projection 19 engages with the fore end portion 8*b* of the guide opening 8, and the guide projection 18 engages with the rear end portion 8*a* of the guide opening 8. The preliminary lock projection 17 has disengaged from the guide opening 8.

The final locking projection 14 of the rear holder 4 enters the opening 10 with a deflection thereof. As illustrated in FIG. 10, a root portion 14*a*1 of the inclined stopping surface 14*a*, which is a cross section of the stopping surface 14*a* and the rear end face 5*a* of the base plate 5, abuts against the rear end edge 10*a* (that is, a fore end face corner of the rear side wall 29) of the opening 10. At the same time, the rear end face 5*a* of the base plate 5 abuts against the fore end face 29*a* (FIG. 4) of the rear side wall 29 of the connector housing 2. An outer half surface 6*c* of the terminal locking projection 6 abuts against the entrance face 25, thereby reliably locking the rear holder 4 within the opening 10.

Figure 11:
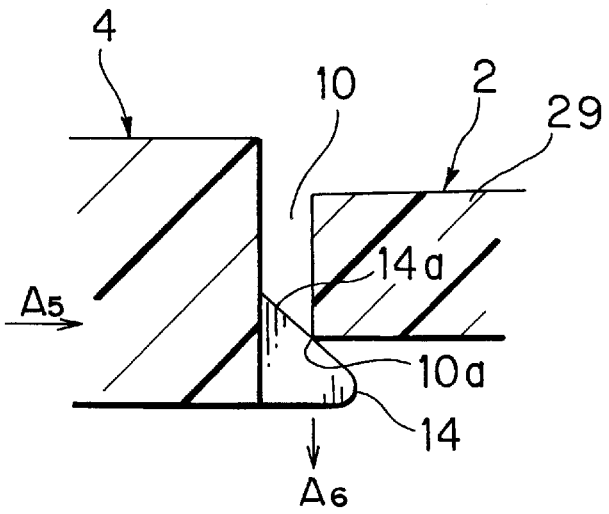
FIG. 11 is a longitudinal sectional view generally showing an operation of the final locking projection.

When there is a comparatavely larger clearance between the rear holder 4 and the connector housing 2 like the known structure, the rear holder 4 tends to move out of the opening 10, that is, to move in an arrow head A4 direction of FIG. 10 (also as illustrated in FIG. 11). This causes a reduced force of the terminal locking projection 6 of FIG. 10 for locking the terminal 26, resulted in disengagement of the terminal 26 due to a forcible pull on an electric cable 35.

In the embodiment, as illustrated in FIG. 11, the inclined stopping surface 14*a* of the final locking projection 14 is abutting against the rear end edge (corner) 10 of the opening 10. Thus, on pulling backward the electric cable 35 of FIG. 10, the rear holder 4 receives a backward force in an arrow head A5 direction of FIG. 11. Thereby, the inclined stopping surface 14*a* slidingly abuts against the rear end edge 10*a* of the opening 10, so that the rear holder 4 is pushed inward in the connector housing 2 in an arrow head A6 direction. Accordingly, as illustrated in FIG. 10, the terminal locking projection 6 having a comparatively large abutment area reliably locks the rear shoulder 26*a* of the terminal 26, which provides a sufficient stopping force for the terminal 26. Furthermore, the rear end face 5*a* of the base plate 5 of the rear holder 4 abuts against the fore end face 29*a* (FIG. 4) of the rear side wall 29 of the connector housing 2 to provide a sufficient final lock force. These stopping forces are sufficient also against a disengagement force of the terminal 26 during the mating with an opposing connector.

On disengagement of the rear holder 4, the inclined stopping surface 14*a* of the final locking projection 14 abuts slidingly smoothly against the rear end edge 10*a* of the opening 10, preventing wear and deformation of the final locking projection 14. The stopping surface 14*a* having an incline angle $\alpha$ (FIG. 2) of about 30° to 45° allows a sufficient abutment force against the rear end edge 10*a*. This provides an adequate locking force for the rear holder 4 and enables a smooth reliable abutment of the stopping surface 14*a* against the rear end edge 10*a* to resist to a forcible pull exerted on the electric cable 35. In addition, the final locking projection 14 having a thickness to keep its resiliency prevents wear and deformation (sagging) of the rear holder 4 on engagement and disengagement of the rear holder 4.

Figure 12:
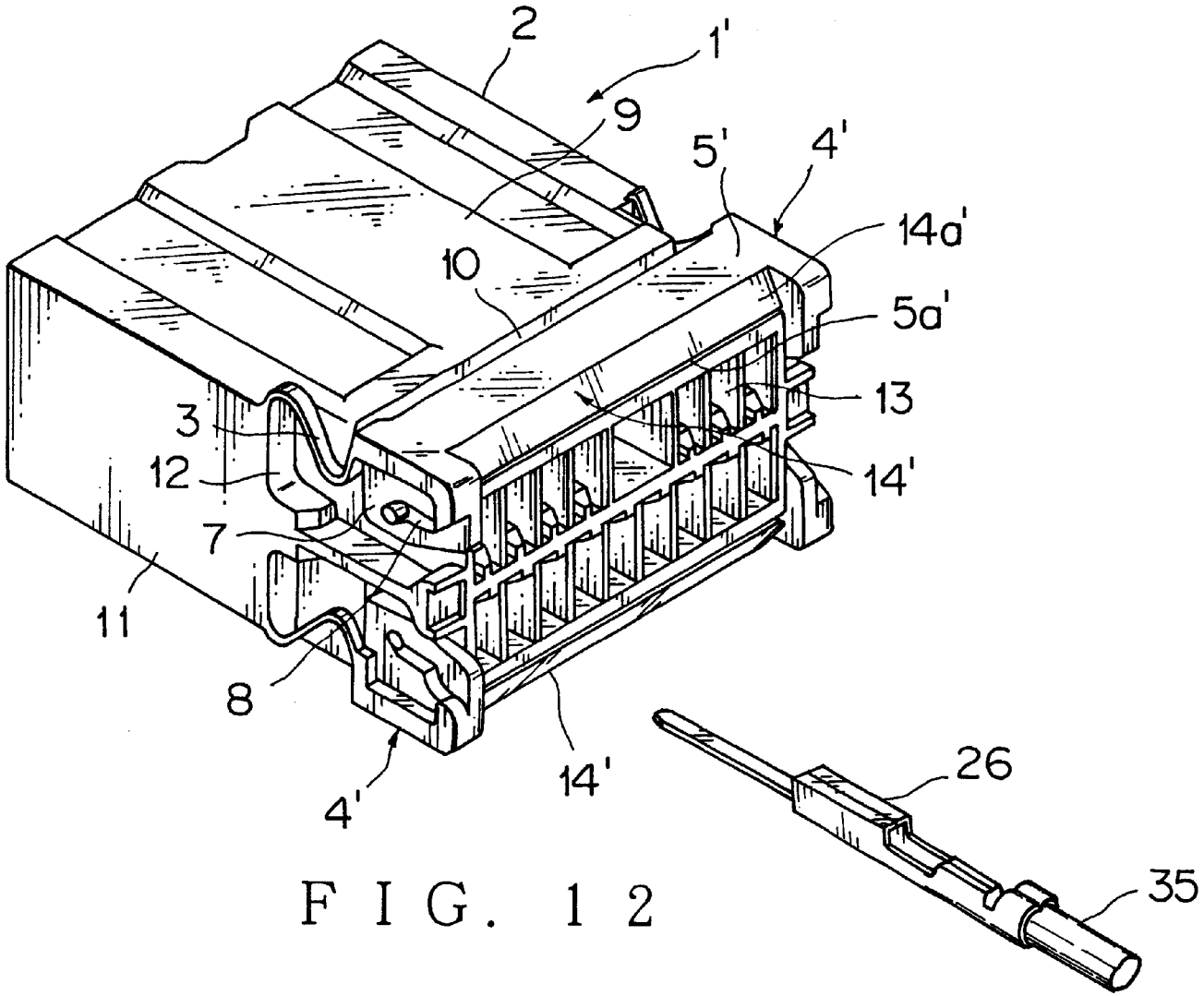
FIG. 12 is an exploded perspective view showing a second embodiment of a terminal double locking connector according to the present invention.
Figure 13:
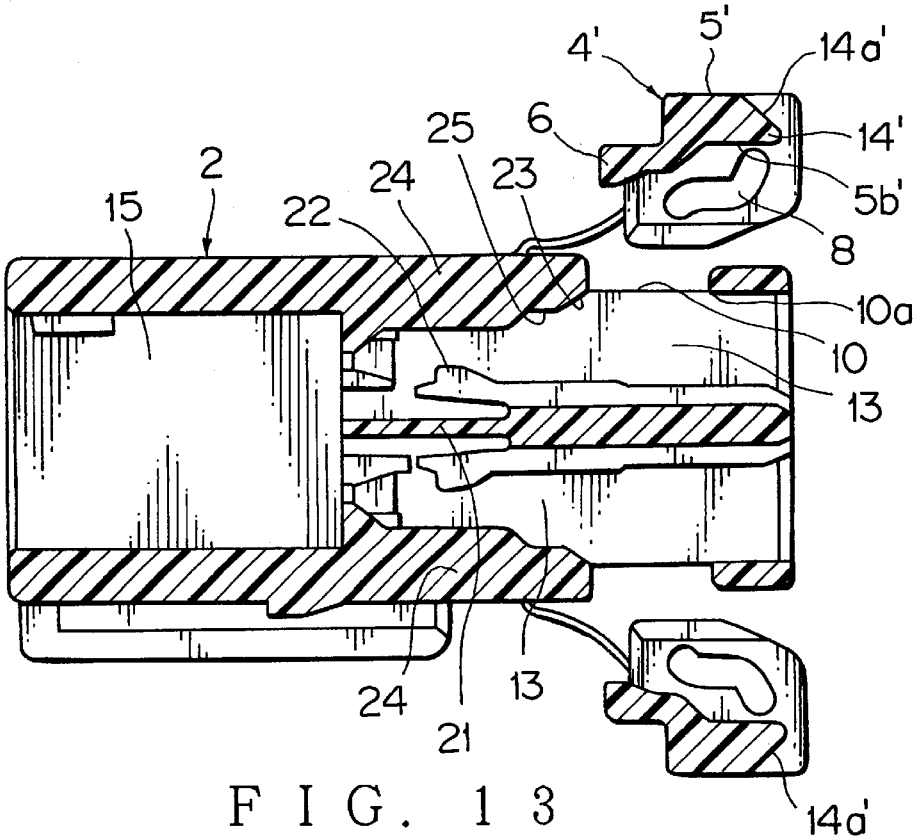
FIG. 13 is a longitudinal sectional view showing the second the embodiment.
Figure 18:
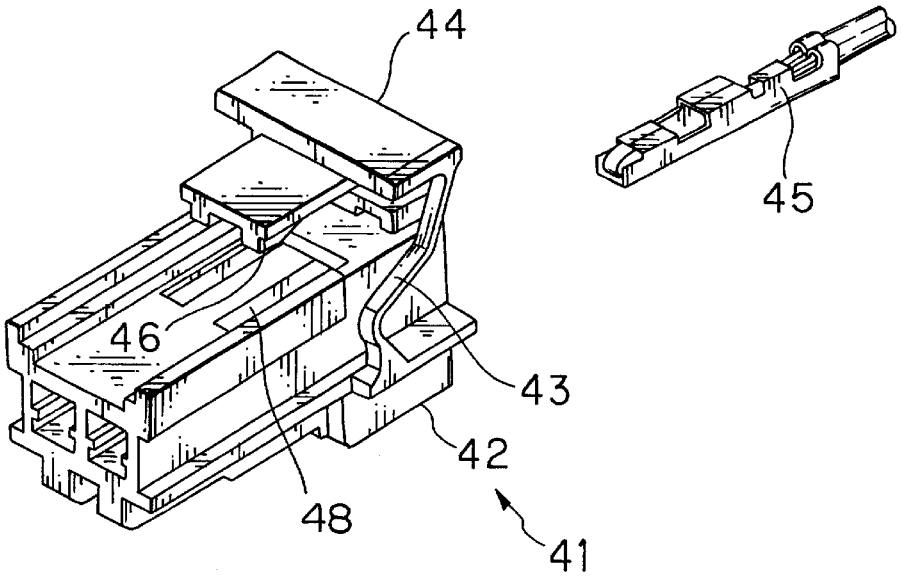
PRIOR ART FIG. 18
FIG. 18 is an exploded perspective view showing a known terminal double locking connector.

FIGS. 12 and 13 show a second embodiment of a terminal double locking connector according to the present invention.

The double locking connector 1' has a rear holder 4' formed with a base plate 5' of which a rear end portion has particularly an inclined stopping surface 14*a'* directly formed thereon.

The stopping surface 14*a'* has a length across the whole distance between both side plates 7 of the rear holder 4' in a rear end portion of the base plate 5'. The rear end portion of the stopping surface 14*a'* of the base plate 5' serves as a final locking portion (locking portion) 14'.

The components other than the locking portion 14' are the same as the first embodiment and have the same reference numerals. Thus, the same components will not be discussed again. In FIG. 12, denoted 5*a'* is a rear end face having a small width adjacent to the stopping surface 14*a'*. In FIG. 13, denoted 5*b'* is an inner surface of the base plate 5'. The inclined stopping surface 14*a'* is an outer surface of the base plate 5' facing toward a disengagement direction of the rear holder 4' in the same way as the first embodiment.

In FIG. 13, the rear holder 4' is inserted through the opening 10 into the connector housing 2, and the stopping surface 14*a'* is abutting against the rear end edge 10*a* of the opening 10 to finally lock the rear holder 4'.

In the same way as the first embodiment shown in FIGS. 10 and 11, even when the rear holder 4' moves in its disengaging direction within the opening 10 due to a pull exerted on the terminal 26, the inclined stopping surface 14*a'* abuts against the rear end edge 10*a* of the opening 10 with a slide allowance. This provides a pushing-back force for the rear holder within the connector housing 2, preventing disengagement of the rear holder 4'.

Figure 20:
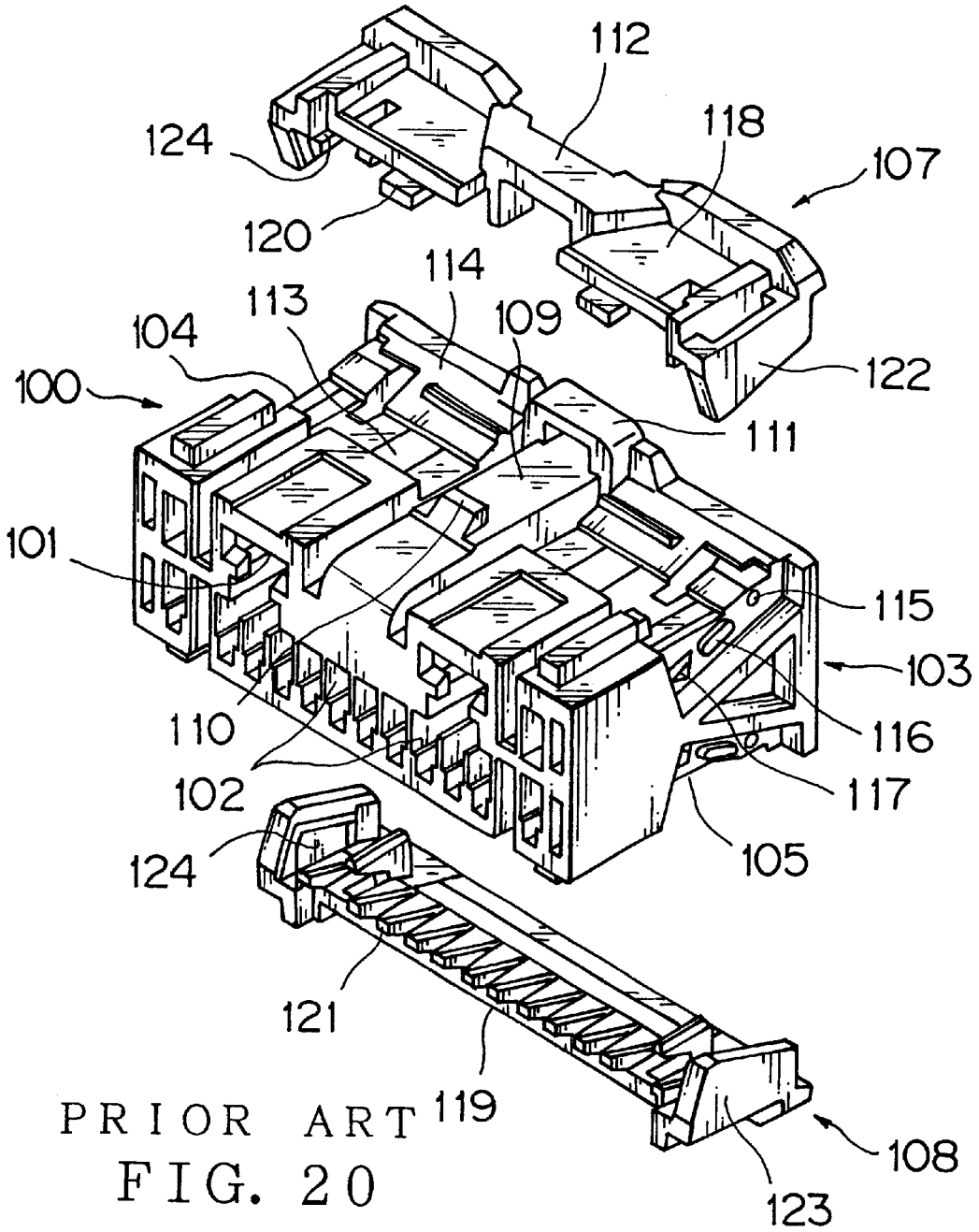
PRIOR ART FIG. 20
FIG. 20 is an exploded perspective view showing another known terminal double locking connector.
Figure 21:
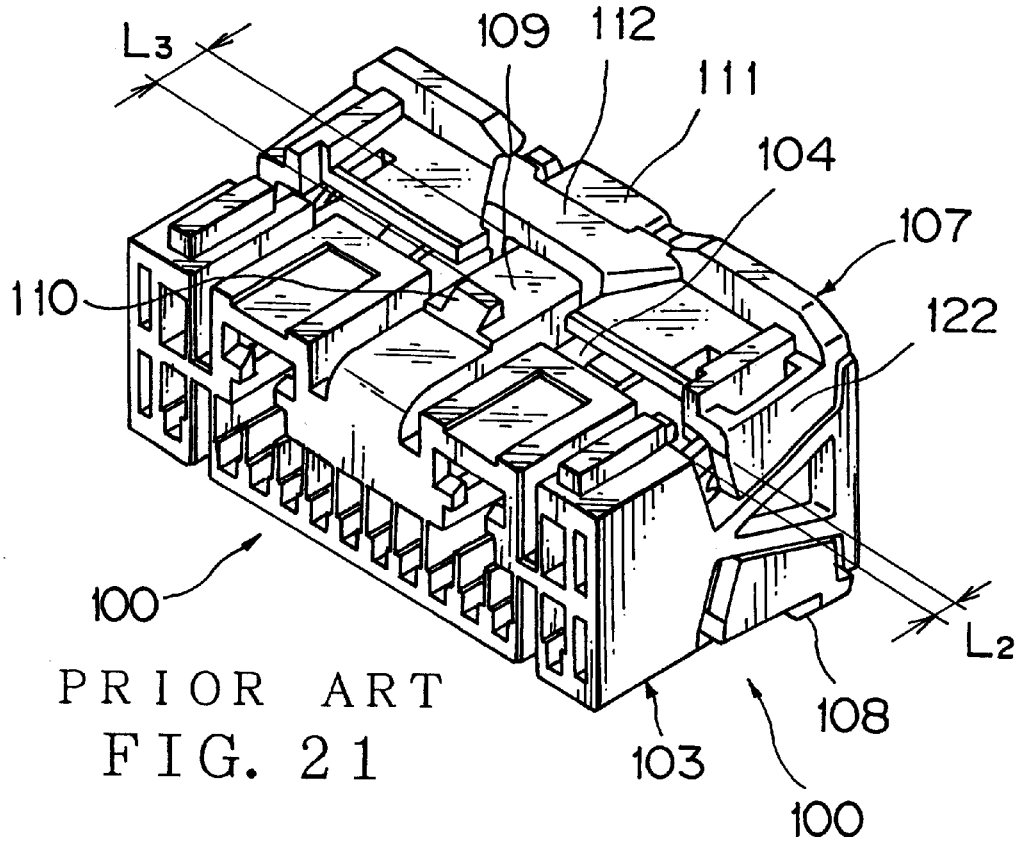
PRIOR ART FIG. 21
FIG. 21 is a perspective view showing a state in which the rear holder is preliminarily locked in a connector housing regrading the connector of FIG. 20.
Figure 22:
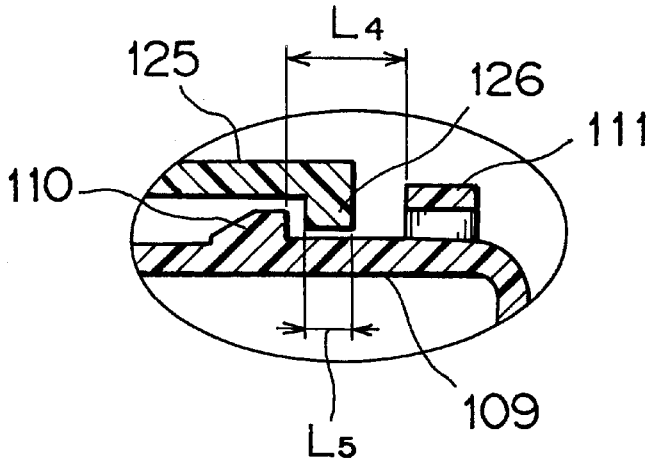
PRIOR ART FIG. 22
FIG. 22 is a longitudinal sectional view generally showing a lock construction of a pair of connector housings of FIG. 20.

In place of the inclined stopping surface 14*a'*, there may be provided a final locking portion like a projection (not shown). In addition, it may be possible that the guide projection 18 and the final lock assisting projection 19 of FIG. 9 compose a final locking portion. The construction of each inclined stopping surface 14*a* or 14*a'* of the embodiments may be applied to a connector such as the known double locking connector (FIG. 20).

FIGS. 14 to 17 show a third embodiment of a terminal double locking connector according to the present invention.

Figure 14:
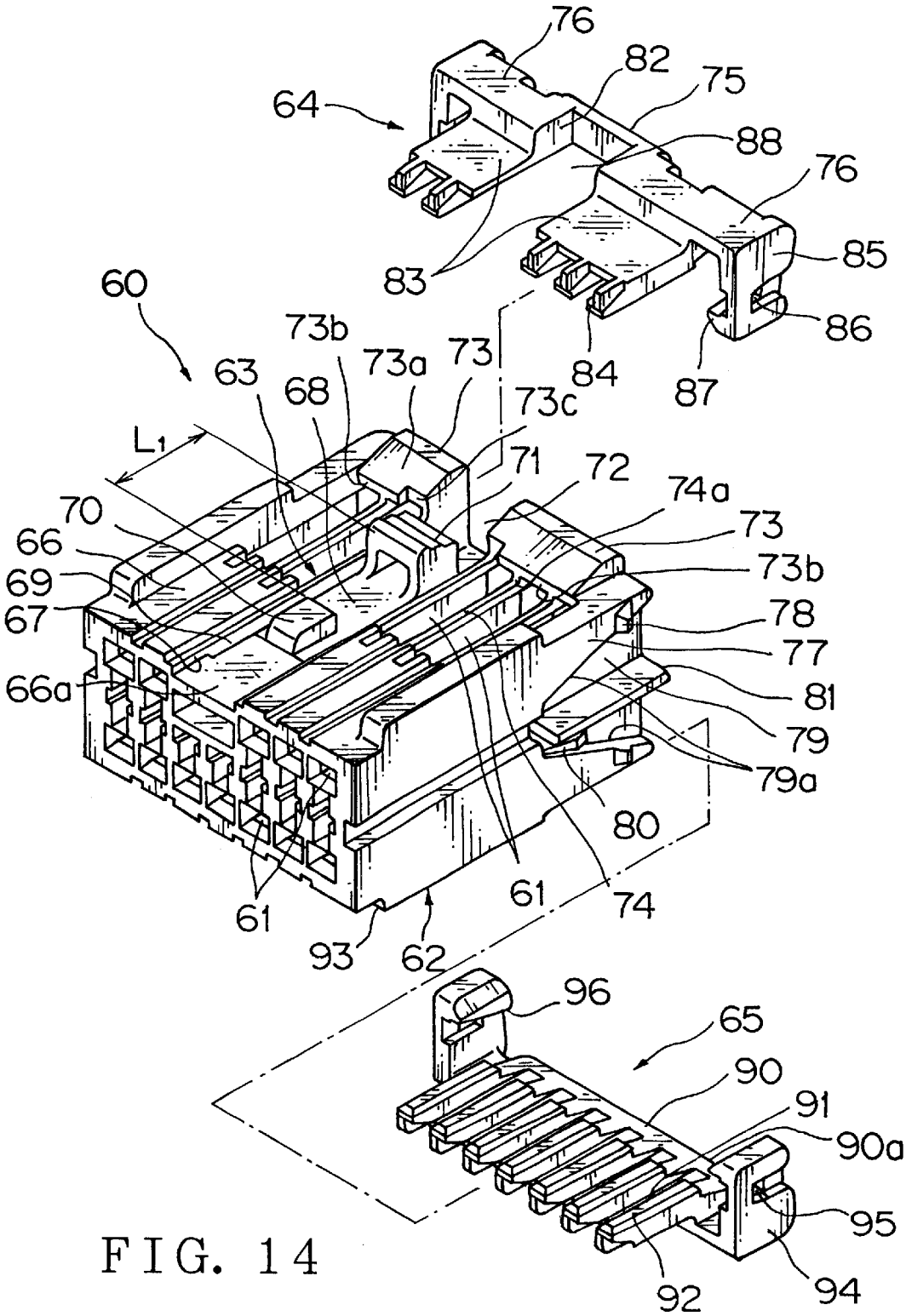
FIG. 14 is an exploded perspective view showing a third embodiment of a terminal double locking connector according to the present invention.

As illustrated in FIG. 14, a double locking connector 60 has a synthetic resin male-type connector housing 62 having a plurality of upper and lower terminal accommodating chambers 61, a pair of synthetic resin rear holders 64, 65 inserted into the connector housing 62 from upper and lower openings 63 of the housing 62, and receptacle-type terminals (not shown) inserted into the upper and lower terminal accommodating chambers 61. The terminals inserted in the lower accommodating chambers are upside-down as compared with those of the upper accommodation chambers.

The connector housing 62 has an upper wall 66 formed with a recess 67 at a middle part thereof. A central wall 66*a* of the upper wall 66 is unitarily provided with a resilient lock arm 68. In each side of the lock arm 68, there is formed one of the openings 63 in the upper wall 66. Between the lock arm 68 and the upper wall 66, there is a slit 69. The lock arm 68 has a lock projection 70 at a longitudinal middle portion thereof and a push projection 71 for releasing the lock at a rear end side thereof. The push projection 71 joins to the connector housing 62 by way of a resilient bent (not shown). The lock projection 70 rises higher than the upper wall 66, and the push projection 71 stands higher than the lock projection 70. The distance L1 between the lock projection 70 and the push projection 71 is enough long to allow an adequate locking force for an engagement portion of an opposing female connector housing (not shown).

In the rear of the push projection 71, the connector housing 62 has a recess 72. In each side of the recess 72, there is provided a rear wall 73 to abut against a rear end surface of the upper rear holder 64. The rear wall 73 has a comparatively large thickness and extends upward higher than the upper wall 66. The rear wall 73 joins to a plurality of partitions 74 separating the terminal accommodating chambers 61. The rear wall 73 has two guide inclined surfaces 73*a* leading to the openings 63. Along the guide inclined surfaces 73, the rear holder 64 is inserted into the openings 63. A fore end face 73*b* of the rear wall 73 leads to a rear end of the opening 63. The fore end face 73*b* of the rear wall 73 is as high as the upper wall 66.

Adjacent to the central recess 72, the fore end face 73*b* of the rear wall 73 has a cutout 73*c* with which a backward embossed portion 75 of the rear holder 64 is engageable. The cutout 73*c* has a width that is approximately a half of the width of the terminal accommodating chamber 61. The fore end face 73*b* and the cutout 73*c* (specifically, a fore face and a side face of the cutout 73*c*) of the rear wall 73 serve as a final locking portion for the rear holder 64. The fore end face of the rear wall 73, which will be referred hereinafter, includes the fore face of the cutout 73*c*.

The inclined rear wall 73 has the cutout at a fore end thereof, so that the fore face of the cutout 73*c* has a higher height than the fore end face 73*b* of the rear wall 73. This provides an increased stopping force for the rear holder 64. Each of the partitions 74 separating transversely the terminal accommodating chambers 61 within the opening 63 joins to the rear wall 73 via a vertically extended portion 74*a*. A fore face of the extended portion wall 74*a* is positioned in a vertical plain in which the fore end face 73*b* of the rear wall 73 is positioned. Both the fore faces can abut against the rear end face of the base plate 76 of the rear holder 64, providing a sufficient reliable locking force.

The connector housing 62 has a side wall 77 at each side of thereof. Near the top or bottom of the side wall 77, there is provided a preliminary lock projection (preliminary lock portion) 78 for the upper or lower rear holder 64. Under or above the preliminary lock projection 78, there is provided a guide groove 79 in a generally normal triangle shape. At an upper or lower end of the guide groove 79, there is provided an inclined surface 79*a*. In a fore end side of the inclined surface 79*a*, a final lock assisting and guiding projection 80 is provided. The upper and lower guide grooves 79 are symmetrical with respect to a partition 81 positioned therebetween. The connector housing 62 has a lower wall formed with an opening (not shown) for inserting the lower rear holder 65.

Figure 15:
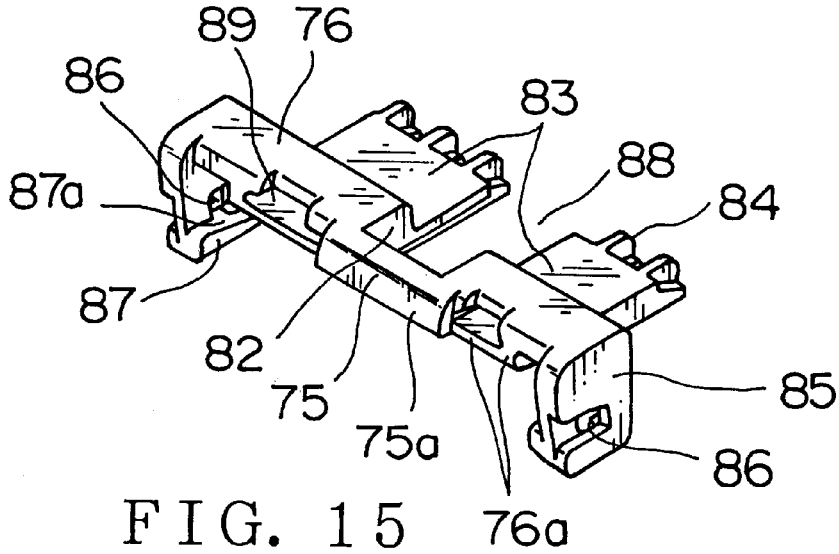
FIG. 15 is a perspective rear view showing an upper rear holder of FIG. 14.

The upper rear holder 64, as illustrated in FIG. 15, has a base plate 76 formed with a rectangular recess 82 corresponding to the push projection 71 of the arm 68 (FIG. 14) at a generally middle portion thereof, a pair of horizontal walls 83 each extending forward from a bottom face of the base plate 76, a plurality of terminal locking projections 84 projecting forward from the wall 83, the backward embossed portion 75 projected backward in the rear side of the recess 82, a pair of side plates 85 each extending from one side of the base plate 76, a preliminary engagement hole (preliminary engagement portion) 86 formed in each side plate 85 to engage with the preliminary lock projection 78 of the connector housing 62, and a hook 87 projecting inward from a lower end portion of each side plate 85.

The recess 82 leads to a recessed space 88 defined between both the walls 83. In the recessed space 88, the lock arm 68 (FIG. 14) will enter. The terminal locking projections 84 are bars projecting from a lower wall of the wall 83. The wall 83 finally covers the opening 63 of the connector housing 62 (FIG. 14) to lead to a part of the upper wall 66. The backward embossed portion 75 positioned in the rear of the recess 82 has the same thickness and height as the base plate 76. The backward embossed portion 75 of a rectangular shape is projecting backward from a rear end of the base plate 76. The backward embossed portion 75 is a part of the base plate 76, and the rear end surface of the base plate 76, which will be discussed hereinafter, includes the rear end surface 75*a* (FIG. 15) of the backward embossed portion 75.

In each side of the backward embossed portion 75, the base plate 76 has a cutout 89 formed in an upper surface thereof. The cutout 89 is facing in the opposite direction of the backward embossed portion 75. The inner hook 87 of each side wall 85 has a tapered face corresponding to the inclined surface 79*a* of the guide groove 79 of the connector housing 62. At one end of the inclined surface 87*a* (FIG. 15) of the hook 87, there is defined a preliminary engagement hole 86.

The rear end surface 76*a* (FIG. 15) of the base plate 76 of the rear holder 64 abuts against the rear end surface of the opening 63 of the connector housing 62, that is, against the fore end face 73*b* of the rear wall 73. Meanwhile, the rear end surface 75*a* (FIG. 15) of the backward embossed portion 75 of the base plate 76 abuts against the fore end face of the cutout 73*c* of the rear side wall 73. This enables a reliable final lock of the rear holder 64, preventing an undesirable disengagement of the rear holder 64 even due to a terminal disengaging force caused by pulling the electric cable.

In FIG. 14, the connector housing 62 has no lock arm provided in a lower housing wall 93. Thus, the lower rear holder 65 does not have such a recess 82 for receiving the lock arm unlike the upper rear holder 64. Accordingly, there is provided a wall 91 extending forward from a base plate 90 across the whole width of the base plate 90. The wall 91 has a plurality of terminal locking projections 92 each upward protruding from an upper surface thereof and formed in a bar shape. The walls 91 finally cover a lower opening (not shown) of the housing to constitute a part of the lower wall 93. A preliminary engagement hole 95 and a hook 96 of each side wall 94 in regard to the lower rear holder 65 has the same constructions as those of the upper rear holder 64, which will not be discussed again.

In a rear end of the lower opening (not shown), there is provided a rear wall (not shown) having a thickness and inclination similar to the upper rear wall 73. However, the lower rear wall has no cutout such as the recess 72. The fore end face of the rear side wall is the rear end surface of the opening and can abuts against a rear end surface 90*a* of the base plate 90 of the lower rear holder 65. The fore end face of the rear wall serves as a final locking portion for the lower rear holder 65. On pulling an electric cable with a terminal, the rear holder 65 can abut against the fore end face of the rear wall to provide a reliable final lock thereof.

Figure 16:
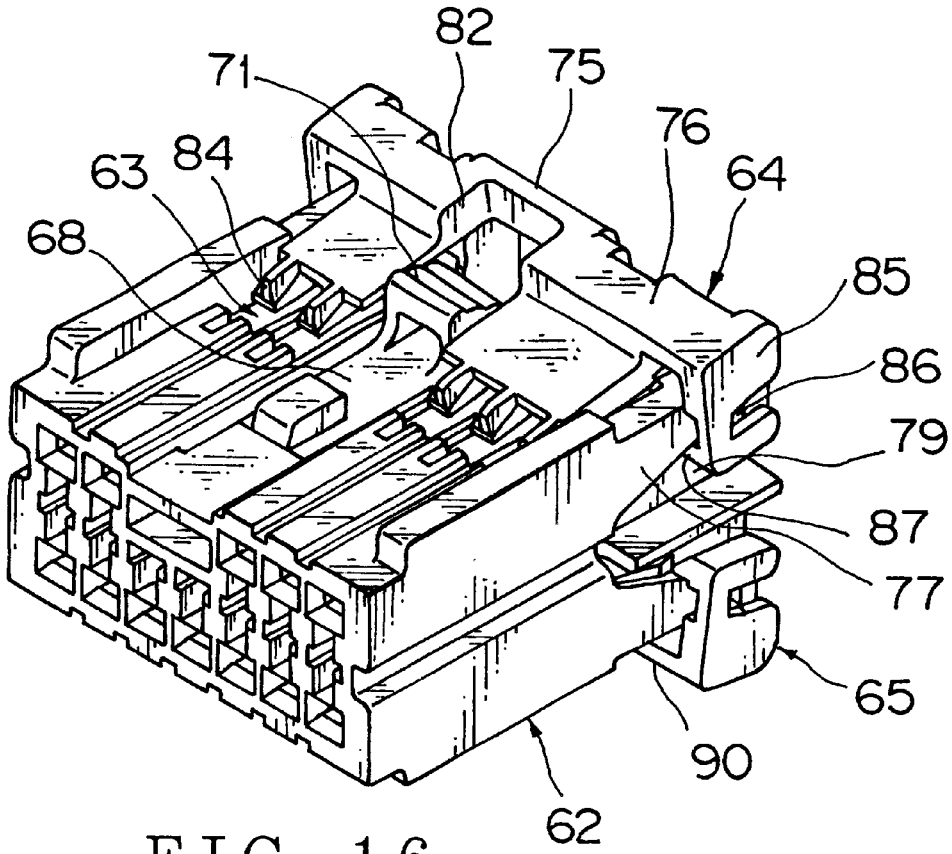
FIG. 16 is a perspective view showing a state in which the rear holder is preliminarily locked in a connector housing.

FIG. 16 shows a preliminary lock state of the upper and lower rear holders 64, 65. Referring to the upper rear holder 64, each side plate 85 of the rear holder 64 is positioned outside each side wall 77 of the connector housing 62. The preliminary lock projection 78 (FIG. 14) of the connector housing 62 abuts against the preliminary engagement hole 86 of the rear holder 64. The rear holder 64 is facing diagonally downward along the guide inclined surface 73*a* of the rear wall 73 (FIG. 14) of the connector housing 62.

The terminal locking projection 84 of the rear holder 64 is coming in a longitudinal intermediate portion of the opening 63 of the connector housing 62. The recess 82 of the rear holder 64 is behind the push projection 71 of the lock arm 68 of the connector housing 62 with a space therebetween. The hook 87 of the side plate 85 of the rear holder 64 is coming in the guide groove 79 of the side wall 77 of the connector housing 62 and is contacting the inclined surface 79*a* (FIG. 14). The lower rear holder 65 is in a preliminary lock state similar to the upper rear holder 64.

Figure 17:
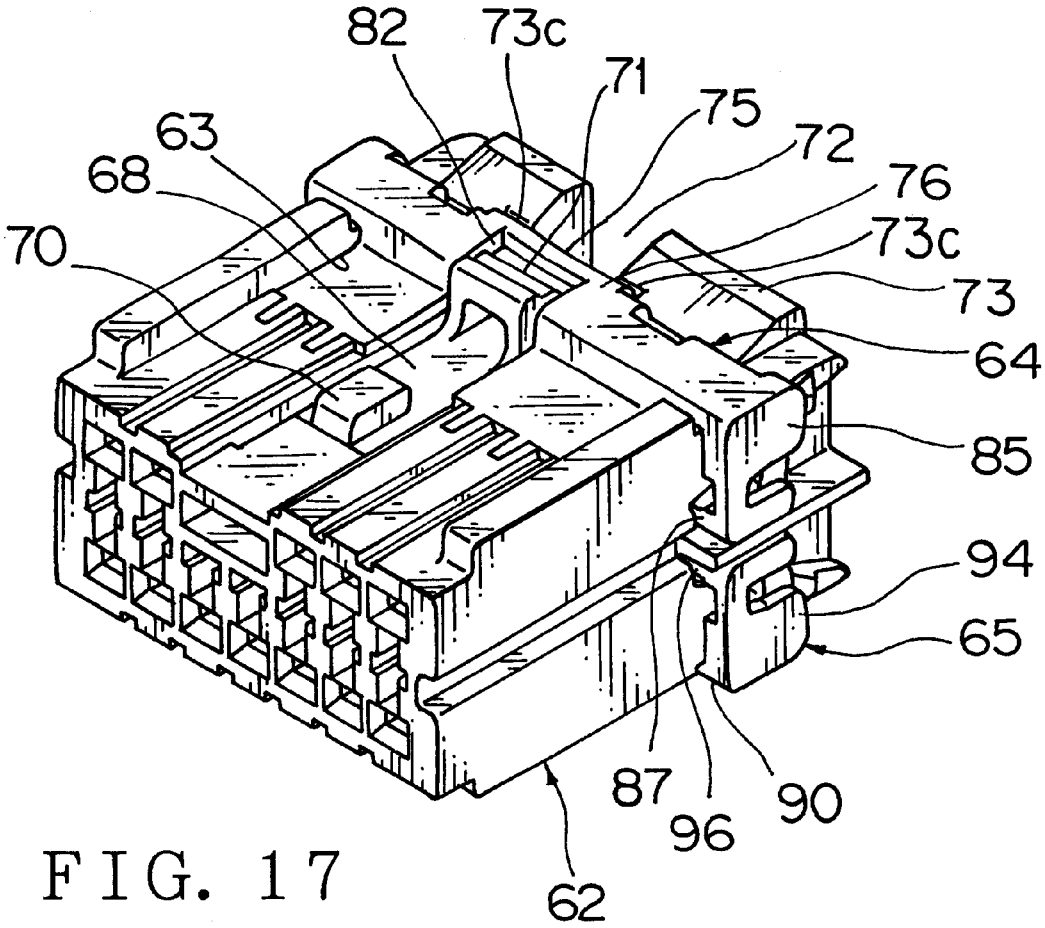
FIG. 17 is a perspective view showing a state in which the rear holder is finally locked in the connector housing.
Figure 19:
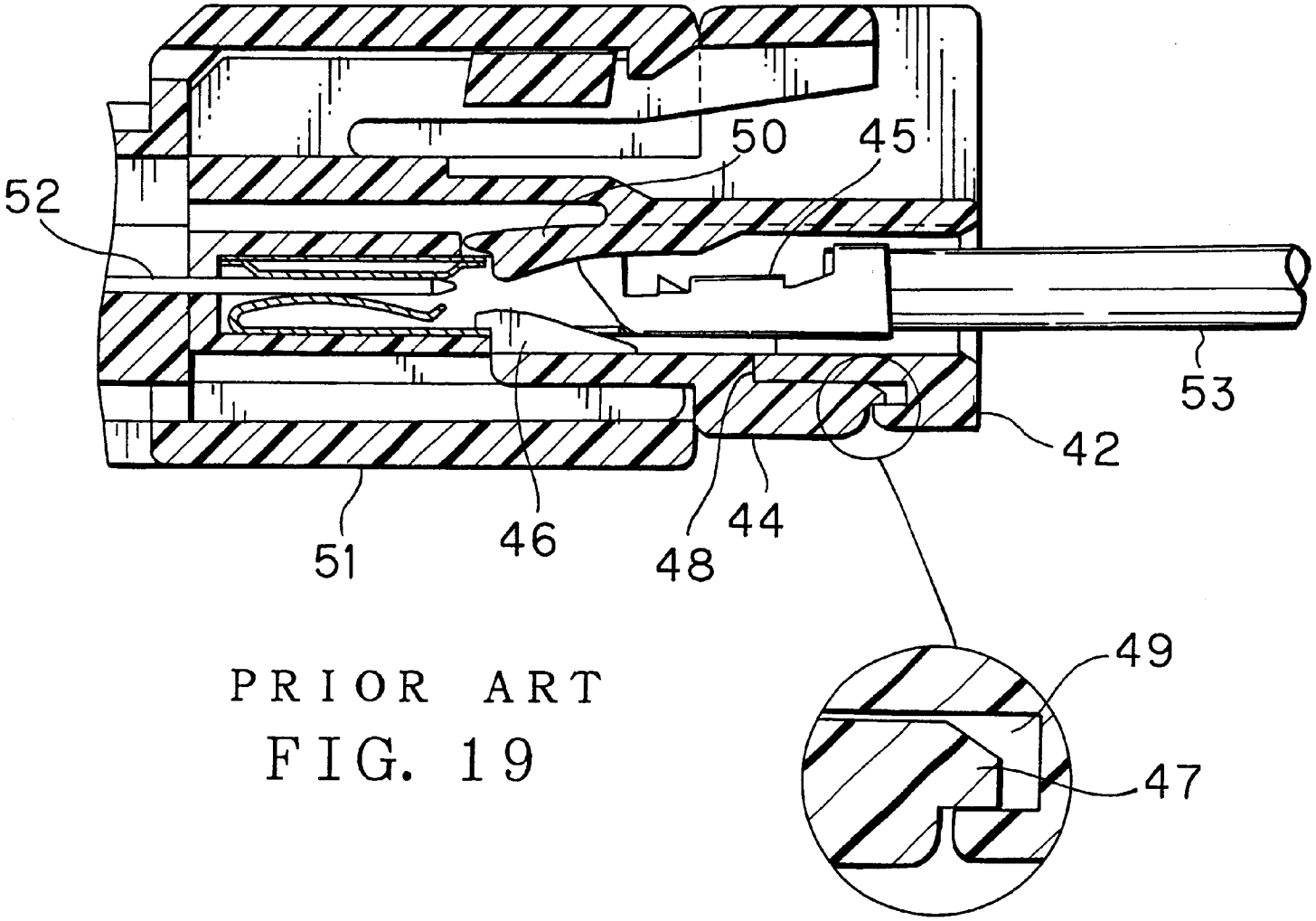
PRIOR ART FIG. 19
FIG. 19 is a longitudinal sectional view showing an assembled state of the double locking connector of FIG. 18.

Pushing diagonally downward the base plates 76, 90 or the backward embossed portions 75 of the rear holders 64, 65, as illustrated in FIG. 17, causes the rear holders 64, 65 to completely engage with the openings 63 (the lower opening is not shown). The rear end surfaces of the base plates 76, 90 each abut against one of the rear end surfaces of the openings 63, that is, abut one of the fore end faces of the rear side walls 73 (the lower rear side wall is not shown), allowing the rear holders 64, 65 to be reliably finally locked with a sufficient locking force.

The push projection 71 of the lock arm 68 is received in the recess 82 of the rear holder 64. On the final locking, the hooks 87, 96 of the side plates 85, 94 of the rear holder 64, 65 slides along the inclined surface 79*a* of the guide groove 79 (FIG. 14). Then the hooks 87, 96 each ride over a wedge-shaped guide projection (final lock assisting projection) 80 (FIG. 14) positioned in a leading end of the guide groove 79 to lock to the guide projection with no looseness therebetween. The terminal locking projections 84, 92 (FIG. 14) of the rear holders 64, 65 enter the terminal accommodating chambers 61 to abut against, for example, the rear shoulders, resulted in the double locking of the terminals (not shown).

Each side part of the backward embossed portion 75 of the rear holder 64 engages with the cutout 73*c* of the rear side wall 73 of the connector housing 62. This increases the final lock force of the rear holder 64, and allows a reliable final positioning of the rear holder 64, preventing a looseness in the transverse (right and left) direction of the rear holder 64. Particularly, the center backward embossed portion 75 of the rear holder 64 abuts against the rear wall 73 of the connector housing 62 to be held thereon. Thus, on pulling the electric cable (not shown) with the terminal, the rear holder 64 makes no arcuate deflection with an increased final lock force, allowing a reliable locking of the terminals. This is different from the prior art connector of which the rear holder is held only by each side portion thereof in its final lock state.

Furthermore, the rear holder 64, unlike the prior art (FIG. 20), does not cross over the lock arm 68 and has the recess 82 for receiving the lock arm 68. Moreover, the backward embossed portion 75 of the rear holder 64 is positioned at the back of the lock arm 68. Thus, the distance L1 (FIG. 14) between the lock projection 70 and the push projection 71 can be sufficiently long, thereby, an opposing female-type connector housing (not shown) can have an engagement portion having a sufficient stiffness to engage with the lock projection 70, increasing the locking force of the male and female connectors.

In addition, the upper rear holder 64 has the recess 82 and the backward embossed portion 75, so that, on intentionally releasing the final lock of the rear holder 64, the rear holder 64 can be easily disengaged from the connector housing, for example, by inserting a tool bar (not shown) into the recess 72 of the backward embossed portion 75 of the connector housing 62 to give a disengaging force.

It is noted that the terms of "upper" and "lower" are conveniently used to show the position of the components in the accompanied drawings. Practically, the double locking connectors 1, 1', and 60 can be positioned in an upside-down state or can be oriented in a horizontal direction.

What is claimed is:

1. A terminal double locking connector comprising:

a connector housing, a terminal inserted into said connector housing, and a rear holder, having a base plate, for locking the terminal, which is inserted into an opening of said connector housing in a direction intersecting with the terminal insertion direction, said base plate of said rear holder having at a rear end face thereof a locking portion being engageable underneath a rear end edge of the opening, wherein said locking portion has an inclined stopping surface facing in a disengaging direction of said rear holder, and the inclined stopping surface can slide underneath the rear end edge of the opening of said connector housing on inserting the rear holder into said connector housing, said base plate having a fore end which is engageable with said connector housing.

2. The double locking connector set forth in claim 1, said locking portion of said rear holder is a locking projection.

3. The double locking connector set forth in claim 1, wherein a rear end of said rear holder has the inclined stopping surface to compose said locking portion.

4. The double locking connector set forth in claim 1, wherein said rear holder has a guide opening on a side surface thereof and the connector housing is formed with a projection which is engageable with said guide opening when the rear holder is inserted into the connector housing.

* * * * *